US006209894B1

(12) United States Patent
Walker, IV

(10) Patent No.: US 6,209,894 B1
(45) Date of Patent: Apr. 3, 2001

(54) SUMMER SLED

(76) Inventor: Matt Walker, IV, 10538 Emerald Ridge, St. Louis, MO (US) 63114

( * ) Notice: Subject to any disclaimer, the term of this patent is extended or adjusted under 35 U.S.C. 154(b) by 0 days.

(21) Appl. No.: 09/240,838

(22) Filed: Feb. 1, 1999

Related U.S. Application Data

(60) Provisional application No. 60/077,596, filed on Mar. 9, 1998.

(51) Int. Cl.[7] ..... A63C 17/00

(52) U.S. Cl. ..... 280/87.042; 280/842; 280/11.222; 280/11.227

(58) Field of Search ..... 280/842, 843, 280/11.22, 11.27, 87.041, 87.042, 11.222, 11.223, 11.226, 11.227

(56) References Cited

U.S. PATENT DOCUMENTS

D. 302,958 8/1989 Shippee et al. .
1,778,850 * 10/1930 Duisenberg ..... 280/11.22
4,244,593 1/1981 Malone .
4,291,891 9/1981 Blanchette .
4,337,957 7/1982 Heine .
5,413,361 5/1995 Mosher .
5,588,658 12/1996 Perner et al. .
5,738,360 * 4/1998 Petell et al. ..... 280/11.22

* cited by examiner

*Primary Examiner*—Michael Mar
(74) *Attorney, Agent, or Firm*—Patent & Trademark Services; Joseph H. McGlynn

(57) ABSTRACT

A sled which will allow the user to experience the joy of sledding when there is no snow on the ground. The sled has wheel racks which are attached to the bottom of the base of the sled, and a plurality of oval wheels are attached to the wheel rack, and the wheels extend from adjacent the front of the sled to adjacent the rear of the sled. The foremost wheels on the wheel rack are smaller that the remaining wheels to allow the sled to be used on grassy surfaces which do not have snow thereon. The smaller wheels will make it easier for the sled to roll on non-linear hills.

1 Claim, 1 Drawing Sheet

FIG. 1
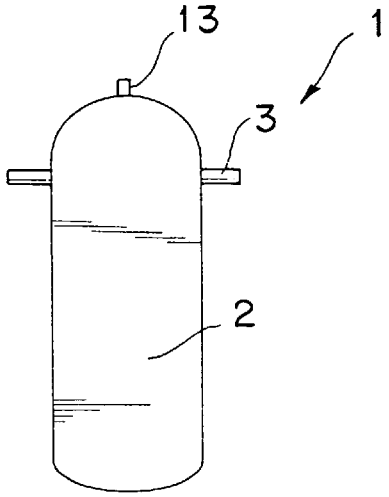
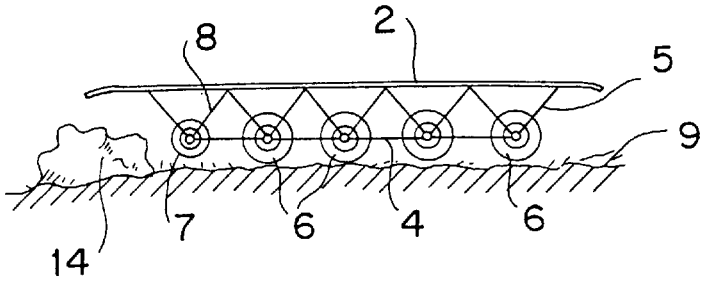
FIG. 2
FIG. 3
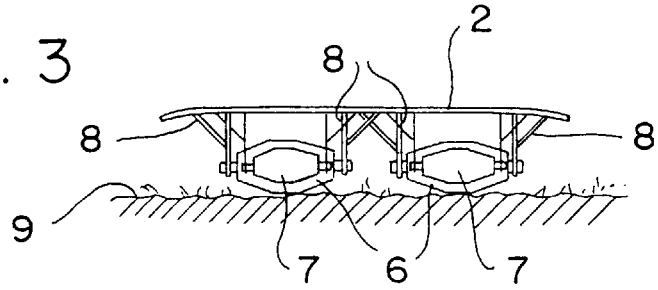
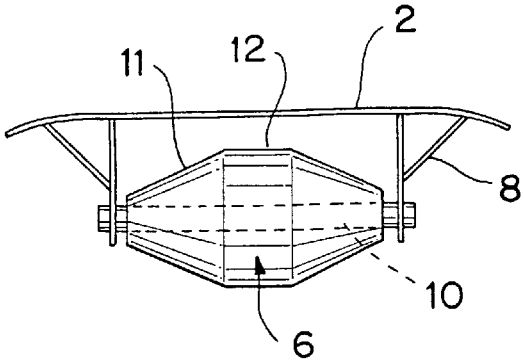
FIG. 4

SUMMER SLED

This is a conversion of Provisional application Ser. No. 60/077,596, filed Mar. 9, 1998.

BACKGROUND OF THE INVENTION

This invention relates, in general, to sleds, and, in particular, to a sled that can be used without snow on the ground.

DESCRIPTION OF THE PRIOR ART

In the prior art various types of sleds have been proposed. For example, U.S. Pat. No. Des. 302,958 to Shippee et al discloses a design for a wagon and one of the embodiments has wheels and the other embodiment has sled runners.

U.S. Pat. No. 4,291,891 to Blanchette discloses a sled having both sled runners and wheels attached to the bottom of the sled.

U.S. Pat. No. 4,244,593 to Malone discloses a sled which can be converted from having individual sled runners at the front and back to wheels at the front and back of the sled.

U.S. Pat. No. 4,337,957 to Heine discloses a conversion kit for converting a child's wagon to a sled.

U.S. Pat. No. 5,413,361 to Mosher discloses a set of ski rails that can be attached to the wheels of a wagon to convert the wagon to a sled.

U.S. Pat. No. 5,588,658 to Perner et al discloses a device for mounting rollers on inline roller skates at different vertical positions on the frame of the skates.

SUMMARY OF THE INVENTION

The present invention is directed to a sled, of the type which is normally provide with runners for use on snow, but in the present invention, the sled has been provided with wheels that can be used on a grassy surface. The sled of the present invention has wheel racks which are attached to the bottom of the base of the sled, and a plurality of oval wheels are attached to the wheel rack and the wheels extend from adjacent the front of the sled to adjacent the rear of the sled. The foremost wheels on the wheel rack are smaller that the remaining wheels to allow the sled to be used on grassy surfaces which do not have snow thereon. The smaller wheels will make it easier for the sled to roll on non-linear hills.

It is an object of the present invention to provide a new and novel sled which can be used when there is no snow on the ground.

It is an object of the present invention to provide a new and novel sled which can be used for entertainment by the entire family.

It is an object of the present invention to provide a new and novel sled which can be used in seasons other than winter.

These and other objects and advantages of the present invention will be fully apparent from the following description, when taken in connection with the annexed drawings.

BRIEF DESCRIPTION OF THE DRAWINGS

FIG. 1 is top view of a sled which can be used with the present invention.

FIG. 2 is a side view of the wheel rack of the present invention.

FIG. 3 is a front view of the wheel rack of the present invention.

FIG. 4 is a front view of one of the wheels of the present invention.

DESCRIPTION OF THE PREFERRED EMBODIMENT

Referring now to the drawings in greater detail, FIG. 1 shows a conventional sled 1 commonly used on snow. The sled has an upper surface 2 that the user will sit or lay on while sledding and hold bars 3 to support the user's hands or feet on the sled. Also, the loop 13 can be used to attach a rope so the sled can be pulled. It should be noted that the sled 1 shown in FIG. 1 is merely for illustrational purposes, and the present invention is not limited to being used with any particular type of sled.

While snow sleds, such as the one illustrated in FIG. 1 have been used by children for years after a snow fall, they have been limited in use to just the winter months. The present invention will allow children to enjoy sledding during the other three seasons of the year.

FIGS. 2 and 3 show a side view and a front view of the wheel rack 4, 5, 8 which is used to support the wheels 6, 7 so the sled of the present invention can be used on grassy surfaces. The wheel rack can be made from any conventional material which will support the wheels for their intended purpose, however plastic is the preferred material. Also, the rack can be assembled in any conventional manner such as by welding or gluing, and can also be manufactured as one unit. The rack 4, 5, 8 will be attached to the bottom of the surface 2 of the sled. The rack can be attached by any conventional fastener. In addition, the specific shape of the rack is not critical, and any supporting structure that will support the wheels can be used.

As can be seen in FIG. 2, the wheels 6, 7 are of different sizes. The wheels 6, which are all approximately the same size, are larger than the wheels 7. This allows the wheels 7, which are mounted toward the front of the sled, to be spaced above the ground surface 9, such as grass, and which will allow the sled to move up and over irregularities in the ground surface such as rocks or slight rises in the ground surface 8. If the wheels 7 were the same size as the wheels 6, the sled would stop when it encountered the obstacle 8. However, with the wheel 7 being smaller, the front of the sled will ride up and over obstacles 8.

FIG. 3 shows a front view of the wheels of the present invention clearly showing the difference in size between the frontmost wheels 7 and the rest of the wheels 6. It should be noted that the wheels shown in FIGS. 2 and 3 are merely for illustrational purposes to show the relative position on the sled and the relative sizes of the respective wheels. They do not show the exact shape of the wheels.

FIG. 4 shows the shape of the wheels and how they are mounted on axles which will support the wheels on the wheel frame. It should be noted that only wheel 6 is shown in FIG. 4, however, wheel 7 will have the same shape only it will be smaller.

The wheel 6 will substantially circular with a small flatten portion 12 in the center of the outer circumference, and two sloping portions 11 extending from the portion 12 to the ends of the wheels. The portions 11 will be longer than the portion 12, thereby giving the wheels a wide stable base which will contribute to the stability of the summer sled. In addition, the wheels will have an aperture extending therethrough from one end to the other, which will receive an axle 10. The axle 10 will be connected to the wheel frames by any conventional means.

In order to use the present invention, the sled, with the wheel rack already attached, can be taken to the nearest grassy hill at any time of the year and, due to the wheel rack attached to the sled, used in the same manner that a snow sled is used during the winter.

Also, it should be noted that the present invention has been described as having the wheel rack attached, by the manufacturer, to the sled, however, the wheel rack could be made as a separate piece and attached by the consumer or user of a normal snow sled to replace the snow runners on a normal snow sled.

Although the Summer Sled and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

For example, it is not necessary that there be two wheels 7 at the front of the sled. One wheel mounted centrally of the sled can be used.

What I claim as my invention is:

1. A sled adapted to be used on grassy surfaces, comprising:

a support platform having a front end, a rear end, longitudinally extending sides, an upper surface and a lower surface, said upper surface including a substantially-planar surface portion for supporting a user;

two longitudinally extending rows of wheels, each row of wheels comprising at least three wheels with a foremost wheel positioned adjacent said front end of said support platform, each wheel having opposed conically shaped end sections and a cylindrically shaped central section extending therebetween, a diameter of the central section of each foremost wheel being smaller than a diameter of the central section of each of the remaining wheels in each row of wheels, and each of the remaining wheels being substantially of the same size;

a supporting axle extending through each of said wheels; and a rack secured to said lower surface for attaching said two rows of wheels in a laterally opposed configuration to said lower surface with each of the supporting axles being positioned in a common plane which is substantially parallel to said substantially planar surface portion of said support platform.

* * * * *